US010415570B2

(12) United States Patent
Chang et al.

(10) Patent No.: US 10,415,570 B2
(45) Date of Patent: Sep. 17, 2019

(54) FAN FRAME BODY WITH BYPASS STRUCTURE AND FAN THEREOF

(71) Applicant: ASIA VITAL COMPONENTS CO., LTD., New Taipei (TW)

(72) Inventors: Bor-Haw Chang, New Taipei (TW); Yu-Tzu Chen, New Taipei (TW); Chung-Shu Wang, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 344 days.

(21) Appl. No.: 15/350,091

(22) Filed: Nov. 13, 2016

(65) Prior Publication Data

US 2018/0135650 A1 May 17, 2018

(51) Int. Cl.

| | |
|---|---|
| ***F04D 19/00*** | (2006.01) |
| ***F04D 27/00*** | (2006.01) |
| ***F04D 29/52*** | (2006.01) |
| *F04D 25/06* | (2006.01) |

(52) U.S. Cl.

CPC ..... *F04D 19/007* (2013.01); *F04D 27/009* (2013.01); *F04D 29/522* (2013.01); *F04D 25/0613* (2013.01)

(58) Field of Classification Search

CPC ..... F04D 19/007

See application file for complete search history.

(56) References Cited

U.S. PATENT DOCUMENTS

| | | | | |
|---|---|---|---|---|
| 7,985,056 | B2 * | 7/2011 | Chou | F04D 19/007 361/695 |
| 8,475,126 | B2 * | 7/2013 | Yoshida | F04D 19/007 415/214.1 |
| 2006/0039110 | A1 * | 2/2006 | Foster, Sr. | F04D 19/007 361/697 |
| 2008/0286135 | A1 * | 11/2008 | Yoshida | F04D 19/007 417/423.5 |

FOREIGN PATENT DOCUMENTS

| | | | | |
|---|---|---|---|---|
| CN | 1664377 | A | 9/2005 | |
| CN | 202301183 | U | 7/2012 | |
| CN | 104295515 | A | 1/2015 | |
| GB | 323231 | A | * 12/1929 | F04D 19/007 |
| TW | M477508 | U | 5/2014 | |

* cited by examiner

*Primary Examiner* — Carlos A Rivera
*Assistant Examiner* — Behnoush Haghighian
(74) *Attorney, Agent, or Firm* — C. G. Mersereau; DeWitt LLP

(57) ABSTRACT

A fan frame body with bypass structure and a fan thereof. The fan includes a first fan, a second fan and a bypass structure. The second fan has a second frame body correspondingly serially connected with a first frame body of the first fan, whereby a first flow way of the first frame body communicates with a second flow way of the second frame body. The bypass structure is disposed in the first flow way or the second flow way. The bypass structure defines a bypass flow way on a circumference of the first flow way or the second flow way. By means of the bypass structure, without increasing the size of the fan and without increasing the consumed power of the fan, the air volume of the fan can be enhanced.

12 Claims, 9 Drawing Sheets

(a)

(b)

(a)

(b)

(a)

(b)

(a)

(b)

(a)

(b)

(a)

(b)

(a)

(b)

(a)

(b)

(a)

(b)

FAN FRAME BODY WITH BYPASS STRUCTURE AND FAN THEREOF

BACKGROUND OF THE INVENTION

1. Field of the Invention

The present invention relates generally to a fan frame body, and more particularly to a fan frame body with bypass structure and a fan thereof.

2. Description of the Related Art

Currently, there is a trend to develop lighter and thinner electronic apparatuses. Therefore, the respective components of the electronic apparatuses are also miniaturized along with the electronic apparatuses. However, after the size of the electronic apparatus is minified, the heat dissipation problem becomes a major obstacle to the improvement of the performance of the electronic apparatus and system. In order to effectively solve the heat dissipation problem of the components in the electronic apparatus, a cooling fan is often used to dissipate the heat generated by the components.

However, the operation speed and the consumed power of the operation unit in the electronic apparatus have become higher and higher. In addition, due to the limitation of the narrow internal space of the electronic apparatus, the size of the fan can be hardly enlarged. Moreover, in order to reduce the total amount of the consumed energy of the electronic apparatus, it is impossible to additionally increase the consumed power of the fan. As a result, the heat dissipation ability of the conventional fan is quite limited.

It is therefore tried by the applicant to provide a fan with bypass structure to solve the above problems existing in the conventional fan.

SUMMARY OF THE INVENTION

It is therefore a primary object of the present invention to provide a fan frame body with bypass structure and a fan thereof. By means of the bypass structure, without increasing the size of the fan, the air volume of the fan can be enhanced.

It is a further object of the present invention to provide a fan frame body with bypass structure and a fan thereof. By means of the bypass structure, without increasing the consumed power of the fan, the air volume of the fan can be enhanced.

To achieve the above and other objects, the fan frame body with bypass structure of the present invention includes: a first frame body having a first flow way, one side of the first flow way being formed with a first opening, while the other side of the first flow way being formed with a second opening; a second frame body correspondingly serially connected with the first frame body, the second frame body having a second flow way, one side of the second flow way being formed with a third opening, while the other side of the second flow way being formed with a fourth opening, the third opening being aligned with the second opening, whereby the first flow way communicates with the second flow way; and a bypass structure disposed in the first flow way or the second flow way, the bypass structure defining a bypass flow way on a circumference of the first flow way or the second flow way.

To achieve the above and other objects, the fan with bypass structure of the present invention includes: a first fan having a first frame body having a first flow way, one side of the first flow way being formed with a first opening, while the other side of the first flow way being formed with a second opening; a second fan correspondingly serially connected with the first fan, the second fan having a second frame body correspondingly serially connected with the first frame body, the second frame body having a second flow way, one side of the second flow way being formed with a third opening, while the other side of the second flow way being formed with a fourth opening, the third opening being aligned with the second opening, whereby the first flow way communicates with the second flow way; and a bypass structure disposed in the first flow way or the second flow way, the bypass structure defining a bypass flow way on a circumference of the first flow way or the second flow way.

By means of the design of the bypass structure, without increasing the size of the fan and without increasing the consumed power of the fan, the air volume of the fan can be enhanced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
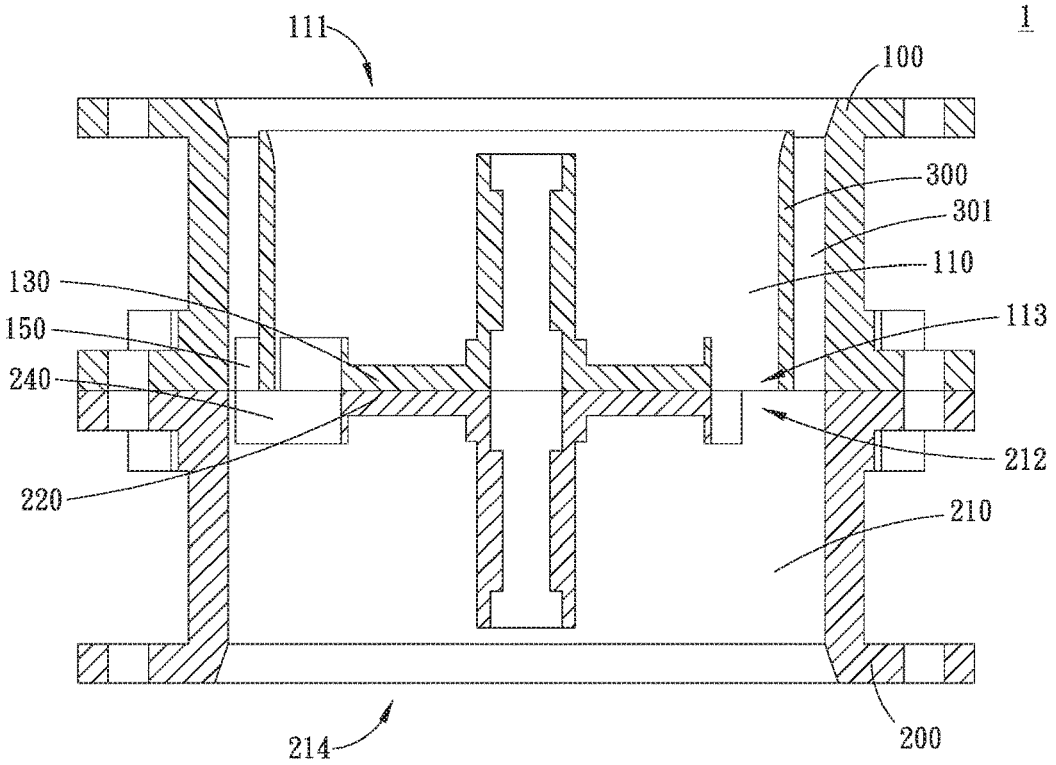
FIG. 1 is a sectional view of a first embodiment of the fan frame body with bypass structure of the present invention.
Figure 1:
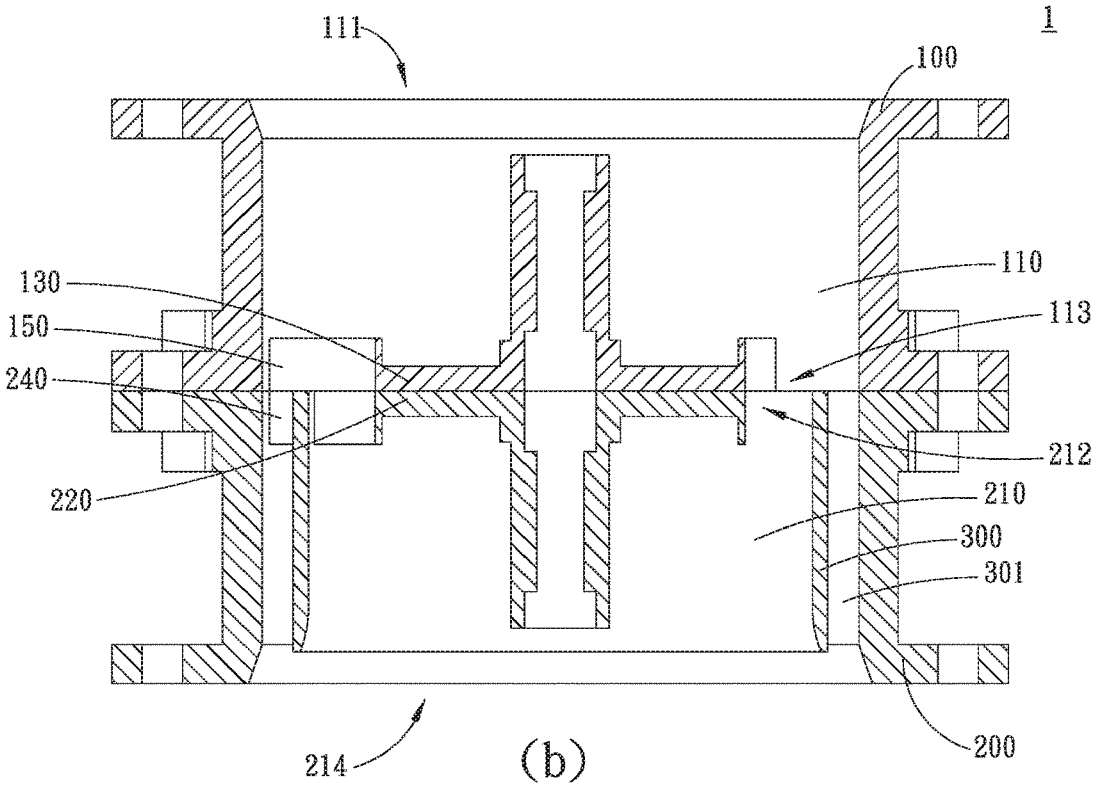

Please refer to FIG. 1. FIG. 1 is a sectional view of a first embodiment of the fan frame body with bypass structure of the present invention. As shown in FIG. 1(*a*), the fan frame body 1 with bypass structure of the present invention includes a first frame body 100, a second frame body 200 and a bypass structure 300. In this embodiment, the fan frame body 1 with the bypass structure is, but not limited to, a fan frame body of a series fan. Alternatively, the fan frame body 1 can be a fan frame body of another type of fan.

The first frame body 100 has a first flow way 110. One side of the first flow way 110 is formed with a first opening 111, while the other side of the first flow way 110 is formed with a second opening 113. The first flow way 110 communicates with the first and second openings 111, 113.

The second frame body 200 is correspondingly serially connected with the first frame body 100. The second frame body 200 has a second flow way 210. One side of the second flow way 210 is formed with a third opening 212, while the other side of the second flow way 210 is formed with a fourth opening 214. The second flow way 210 communicates with the third and fourth openings 212, 214. The third opening 212 is aligned with the second opening 113, whereby the first flow way 110 communicates with the second flow way 210.

The bypass structure 300 is disposed in the first flow way 110 or the second flow way 210. The bypass structure 300 defines a bypass flow way 301 on the circumference of the first flow way 110 or the second flow way 210. In this embodiment, the bypass structure 300 has an I-shaped cross section, whereby the bypass flow way 301 also has an I-shaped cross section.

The following is an embodiment of the present invention for illustration purposes:

Please refer to FIG. 1(*a*). The fan frame body 1 with bypass structure of the present invention includes the first frame body 100 and the second frame body. The first flow way 110 of the first frame body 100 communicates with the first opening 111 and the second opening 113. A first base seat 130 and multiple first connection members 150 are disposed at the second opening 113. The first base seat 130 is connected to the first frame body 100 via the first connection members 150. The first base seat 130 serves to bear a fan motor (not shown). The second frame body 200 is correspondingly serially connected with the first frame body 100. In this embodiment, the first and second frame bodies 100, 200 can be serially connected and assembled with each other in any suitable manner such as engagement, locking, insertion, adhesion or latching. The connection means between the first and second frame bodies 100, 200 is not limited. The second flow way 210 of the second frame body 200 communicates with the third opening 212 and the fourth opening 214. A second base seat 220 and multiple second connection members 240 are disposed at the third opening 212. The second base seat 220 is connected to the second frame body 200 via the second connection members 240. The second base seat 220 serves to bear another fan motor (not shown). The third opening 212 is aligned with the second opening 113, whereby the first flow way 110 communicates with the second flow way 210.

In this embodiment, the bypass structure 300 is formed on the first connection members 150 and positioned in the first flow way 110 to extend toward the first opening 111. The bypass structure 300 and the first frame body 100 and the first connection members 150 together define the bypass flow way 301. In practice, after the fan motors disposed on the first and second base seats 130, 220 are activated, the external airflow at the center of the first opening 111 of the first frame body 100 will be sucked from the first opening 111 into the first flow way 110. The external airflow at the surrounding of the first opening 111 will be sucked from the first opening 111 into the bypass flow way 301. The airflows entering the first flow way 110 and the bypass flow way 301 will flow into the second flow way 210 of the second frame body 200 and mix with each other to exhaust from the fourth opening 214.

In a modified embodiment, as shown in FIG. 1(*b*), the bypass structure 300 is formed on the second connection members 240 and positioned in the second flow way 210 to extend toward the fourth opening 214. The bypass structure 300 and the second frame body 200 and the second connection members 240 together define the bypass flow way 301. In practice, after the fan motors disposed on the first and second base seats 130, 220 are activated, the external airflows at the center and the surrounding of the first opening 111 of the first frame body 100 will be sucked from the first opening 111 into the first flow way 110. The airflows entering the first flow way 110 will flow into the second flow way 210 of the second frame body 200 and the bypass flow way 301. Then, the airflows respectively flow through the second flow way 210 and the bypass flow way 301 to exhaust from the fourth opening 214.

Figure 2:
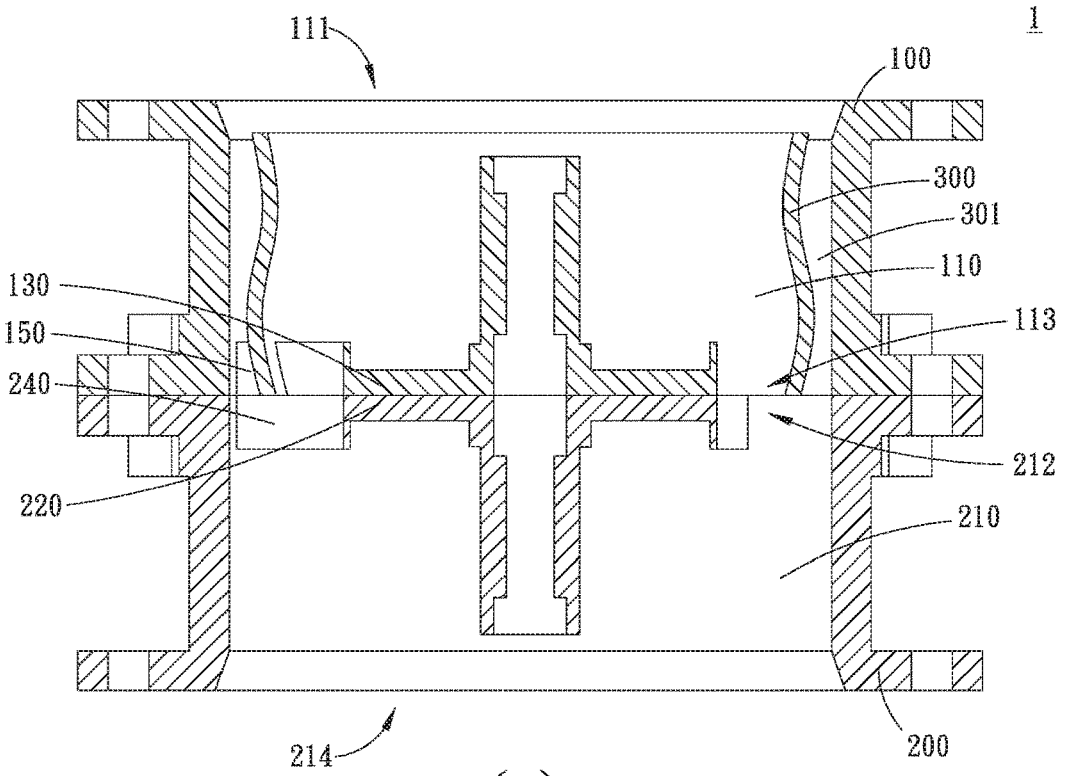
FIG. 2 is a sectional view of a second embodiment of the fan frame body with bypass structure of the present invention.
Figure 2:
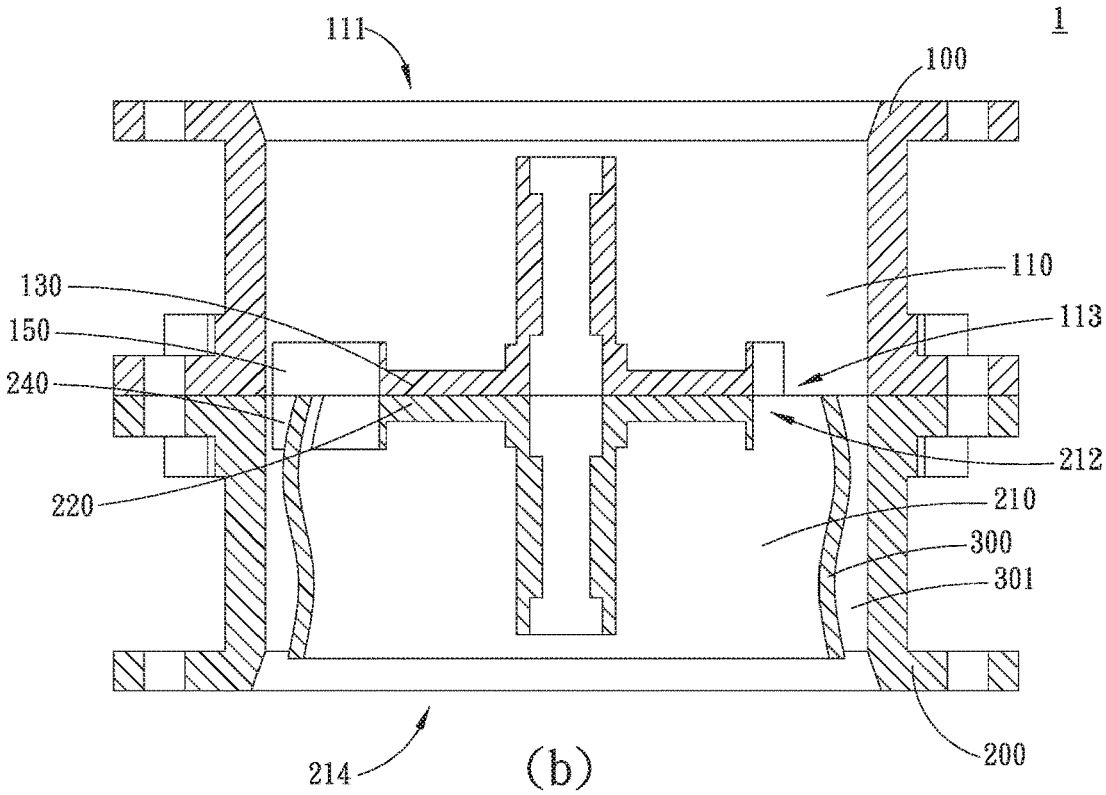

Please now refer to FIG. 2, which is a sectional view of a second embodiment of the fan frame body with bypass structure of the present invention. Also referring to FIG. 1, the second embodiment is partially identical to the first embodiment in structure and function and thus will not be repeatedly described hereinafter. The second embodiment is different from the first embodiment in that the bypass structure 300 has an S-shaped cross section, whereby the bypass flow way 301 also has an S-shaped cross section.

Figure 3:
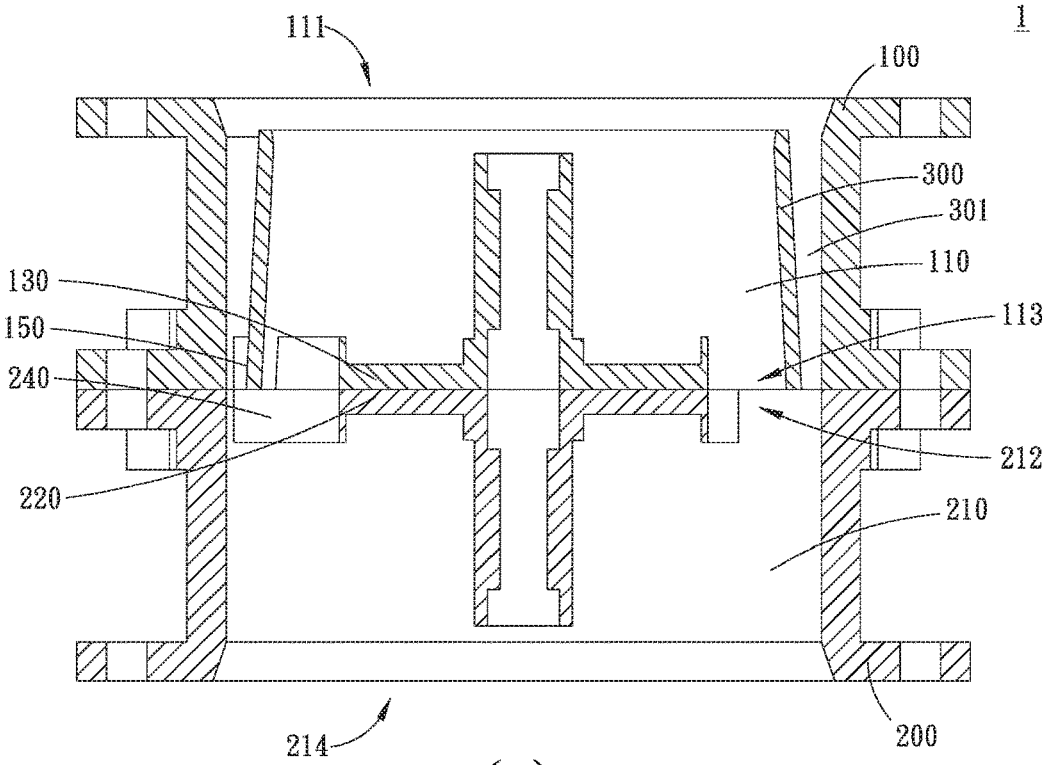
FIG. 3 is a sectional view of a third embodiment of the fan frame body with bypass structure of the present invention.
Figure 3:
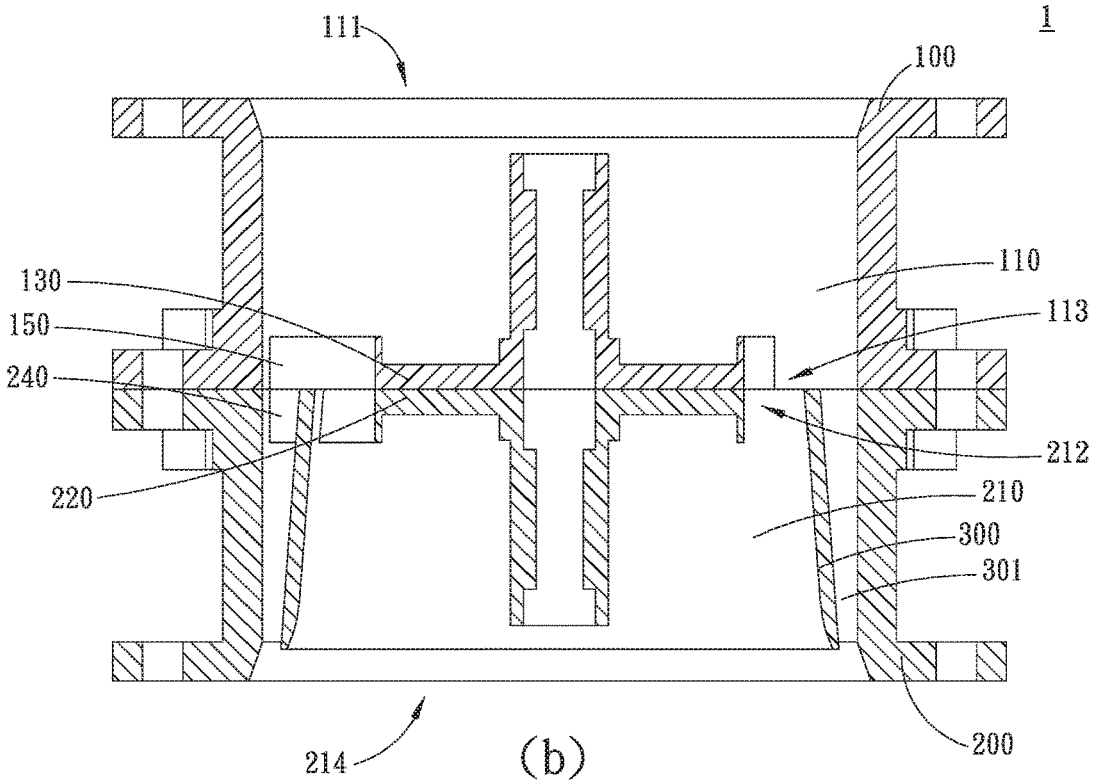

Please now refer to FIG. 3, which is a sectional view of a third embodiment of the fan frame body with bypass structure of the present invention. Also referring to FIG. 1, the third embodiment is partially identical to the first embodiment in structure and function and thus will not be repeatedly described hereinafter. The third embodiment is different from the first embodiment in that the bypass flow way 301 defined by the bypass structure 300 is a tapered flow way. For example, the bypass structure 300 is disposed in the first flow way 110 to extend toward the first opening 111 and the bypass flow way 301 is tapered from the first opening 111 to the second opening 113. Alternatively, the bypass structure 300 is disposed in the second flow way 210 to extend toward the fourth opening 214 and the bypass flow way 301 is tapered from the third opening 212 to the fourth opening 214. The tapered flow way has a larger cross-sectional area at upstream section and a smaller cross-sectional area at downstream section so that the flow speed of the airflow passing through the bypass flow way 301 is increased.

Figure 4:
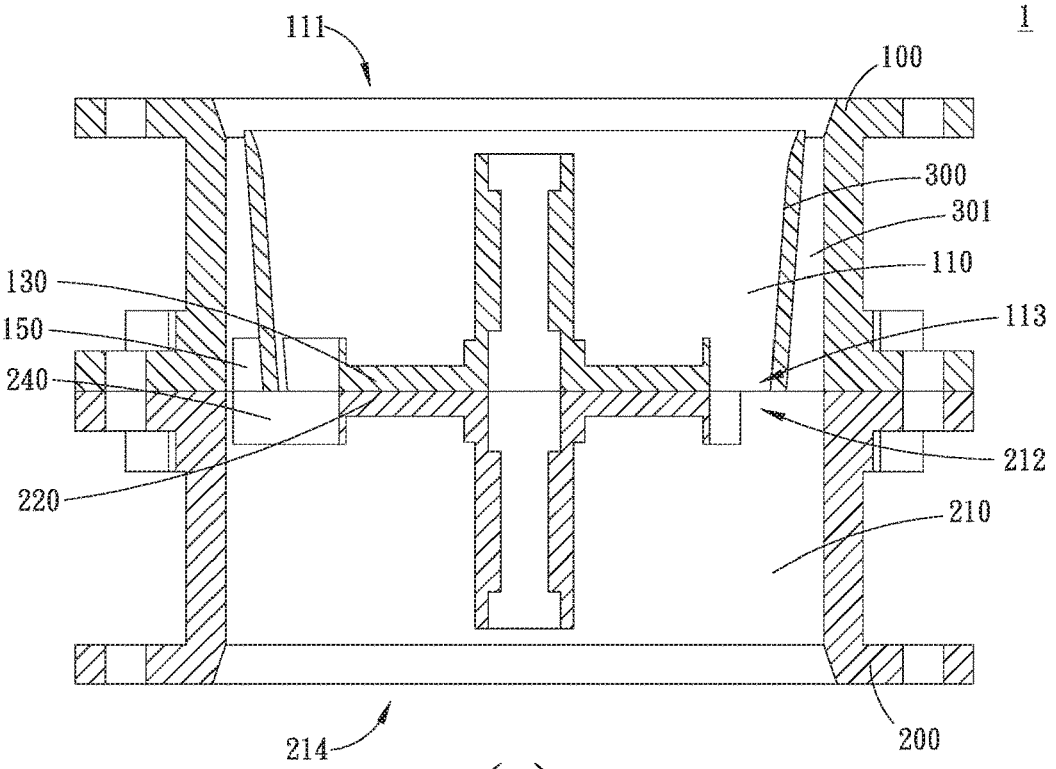
FIG. 4 is a sectional view of a fourth embodiment of the fan frame body with bypass structure of the present invention.
Figure 4:
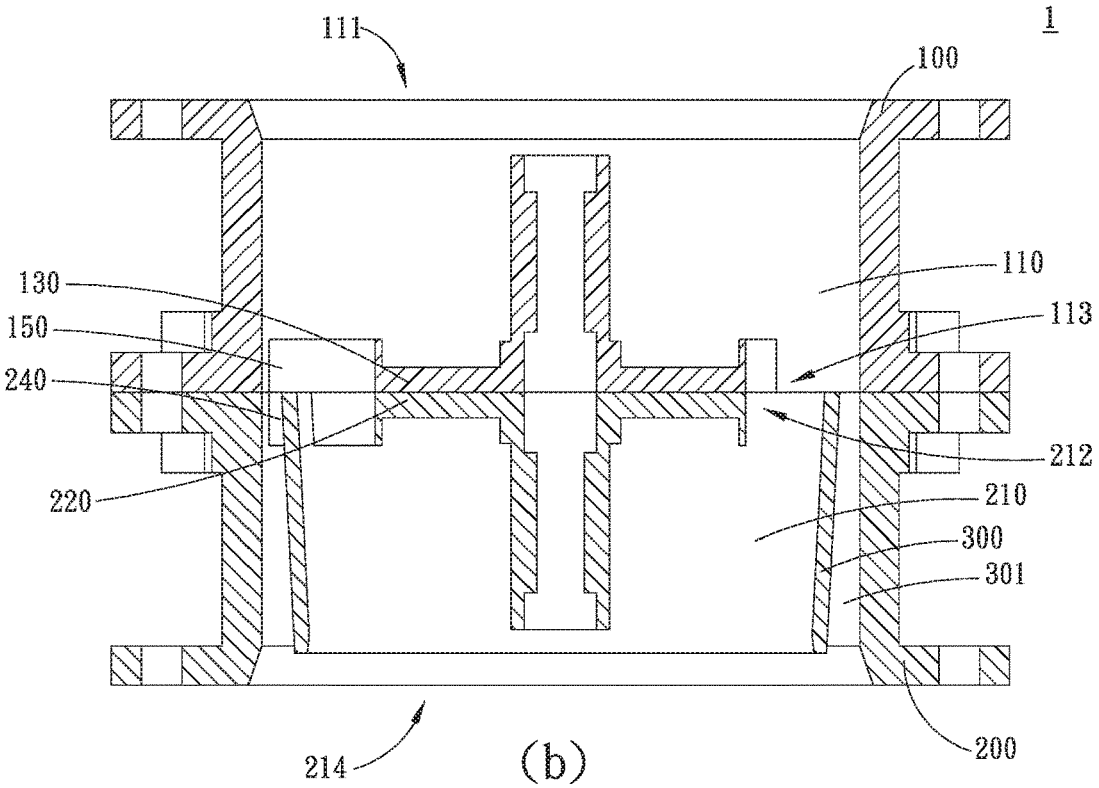

Please now refer to FIG. 4, which is a sectional view of a fourth embodiment of the fan frame body with bypass structure of the present invention. Also referring to FIG. 1, the fourth embodiment is partially identical to the first embodiment in structure and function and thus will not be repeatedly described hereinafter. The fourth embodiment is different from the first embodiment in that the bypass flow way 301 defined by the bypass structure 300 is a diverging flow way. For example, the bypass structure 300 is disposed in the first flow way 110 to extend toward the first opening 111 and the bypass flow way 301 is diverged from the first opening 111 to the second opening 113. Alternatively, the bypass structure 300 is disposed in the second flow way 210 to extend toward the fourth opening 214 and the bypass flow way 301 is diverged from the third opening 212 to the fourth opening 214. The diverged flow way has a smaller cross-sectional area at upstream section and a larger cross-sectional area at downstream section. Therefore, after the external airflow at the surrounding of the first opening 111 is sucked into the bypass flow way 301, the flow speed of the airflow passing through the bypass flow way 301 is decreased and the pressure is increased, whereby the airflow can be truly pushed and exhausted outside.

Figure 5:
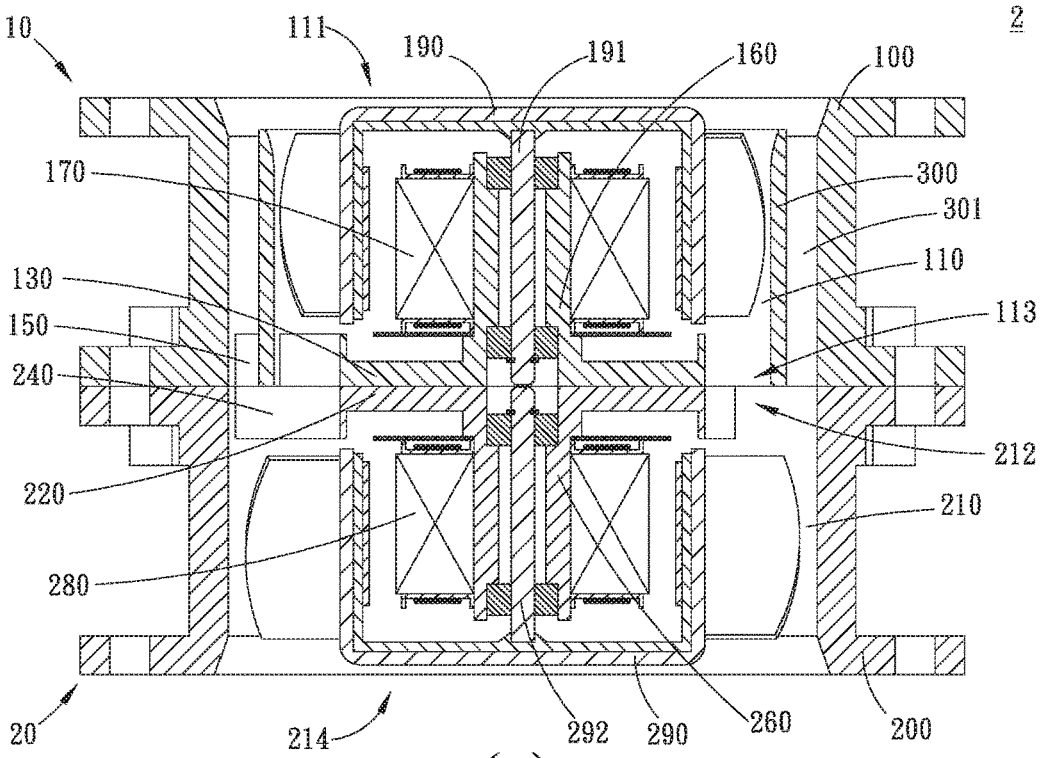
FIG. 5 is a sectional view of a first embodiment of the fan with the bypass structure of the present invention.
Figure 5:
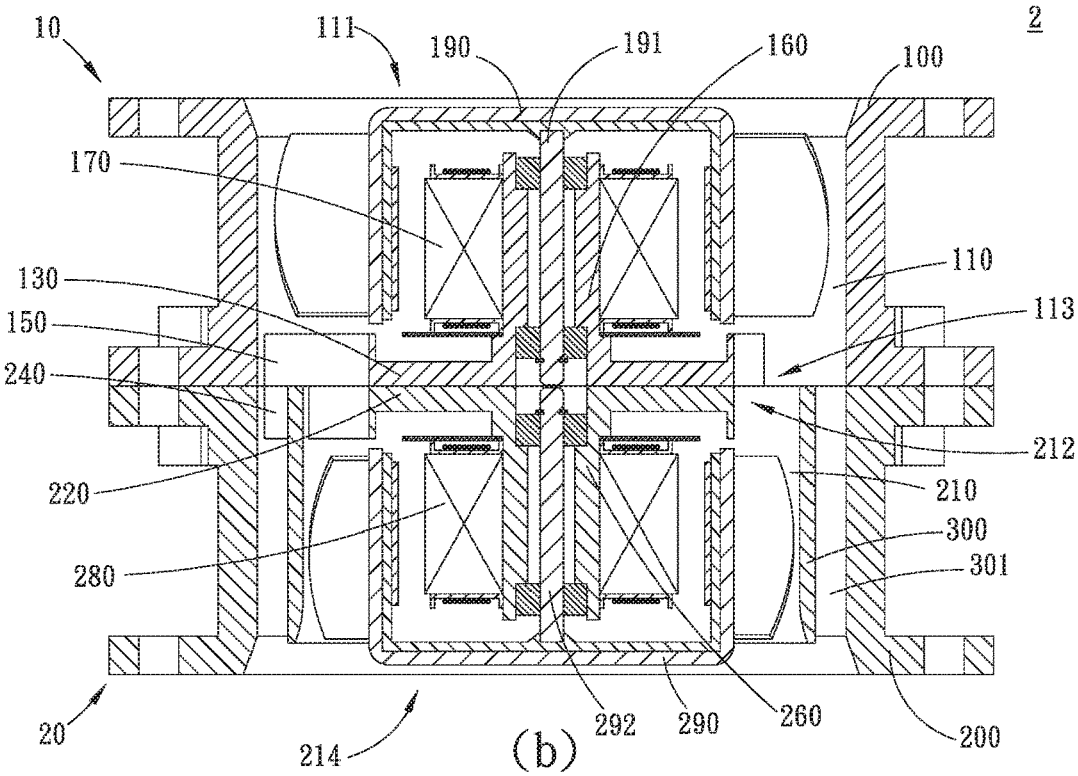

Please now refer to FIG. 5, which is a sectional view of a first embodiment of the fan with the bypass structure of the present invention. As shown in FIG. 5(*a*), the fan 2 with bypass structure of the present invention includes a first fan 10, a second fan 20 and a bypass structure 300. In this embodiment, the fan 2 with the bypass structure is, but not limited to, a series fan. Alternatively, the fan 2 can be another type of fan.

The first fan 10 has a first frame body 100. The first frame body 100 has a first flow way 110. One side of the first flow way 110 is formed with a first opening 111, while the other side of the first flow way 110 is formed with a second opening 113. The first flow way 110 communicates with the first and second openings 111, 113.

The second fan 20 is correspondingly serially connected with the first fan 10. The second fan 20 has a second frame body 200. The second frame body 200 is correspondingly serially connected with the first frame body 100. The second frame body 200 has a second flow way 210. One side of the second flow way 210 is formed with a third opening 212, while the other side of the second flow way 210 is formed with a fourth opening 214. The second flow way 210 communicates with the third and fourth openings 212, 214. The third opening 212 is aligned with the second opening 113, whereby the first flow way 110 communicates with the second flow way 210.

The bypass structure 300 is disposed in the first flow way 110 or the second flow way 210. The bypass structure 300 defines a bypass flow way 301 on the circumference of the first flow way 110 or the second flow way 210. In this embodiment, the bypass structure 300 has an I-shaped cross section, whereby the bypass flow way 301 also has an I-shaped cross section.

The following is an embodiment of the present invention for illustration purposes:

Please now refer to FIG. 5(*a*). The fan 2 with the bypass structure of the present invention includes the first and second fans 10, 20. The first flow way 110 of the first frame body 100 of the first fan 10 communicates with the first opening 111 and the second opening 113. A first base seat 130 and multiple first connection members 150 are disposed at the second opening 113. The first base seat 130 is connected to the first frame body 100 via the first connection members 150. The first fan 10 further has a first bearing cup 160, a first stator 170 and a first rotor 190. The first bearing cup 160 is disposed on the first base seat 130 to extend toward the first opening 111. The first stator 170 is annularly disposed around the first bearing cup 160. The first rotor 190 via a first shaft 191 is inserted in the first bearing cup 160 corresponding to the first opening 111. The second fan 20 via the second frame body 200 is correspondingly serially connected with the first frame body 100 of the first fan 10. In this embodiment, the first and second frame bodies 100, 200 can be serially connected and assembled with each other in any suitable manner such as engagement, locking, insertion, adhesion or latching. The connection means between the first and second frame bodies 100, 200 is not limited.

The second flow way 210 of the second frame body 200 of the second fan 20 communicates with the third opening 212 and the fourth opening 214.

A second base seat 220 and multiple second connection members 240 are disposed at the third opening 212. The second base seat 220 is connected to the second frame body 200 via the second connection members 240. The second fan 20 further has a second bearing cup 260, a second stator 280 and a second rotor 290. The second bearing cup 260 is disposed on the second base seat 220 to extend toward the fourth opening 214. The second stator 280 is annularly disposed around the second bearing cup 260. The second rotor 290 via a second shaft 292 is inserted in the second bearing cup 260 corresponding to the fourth opening 214. The third opening 212 is aligned with the second opening 113, whereby the first flow way 110 communicates with the second flow way 210.

Figure 6:
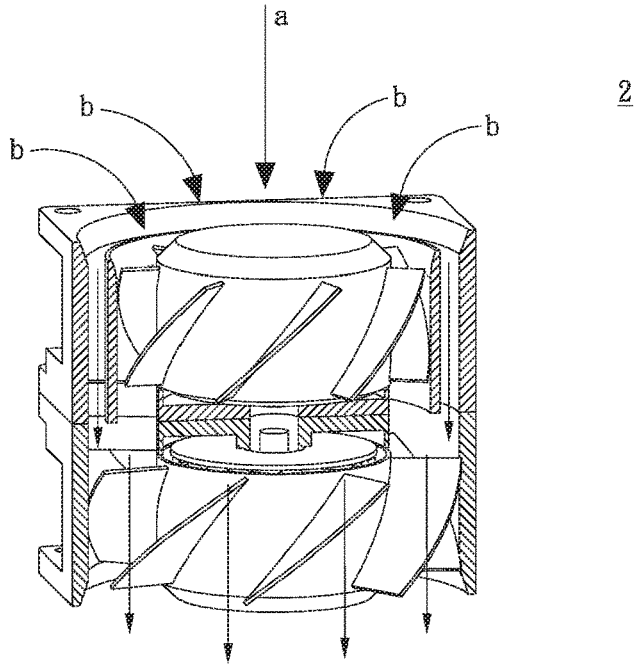
FIG. 6 is a sectional view of the first embodiment of the fan with the bypass structure of the present invention, showing the airflow thereof.
Figure 6:
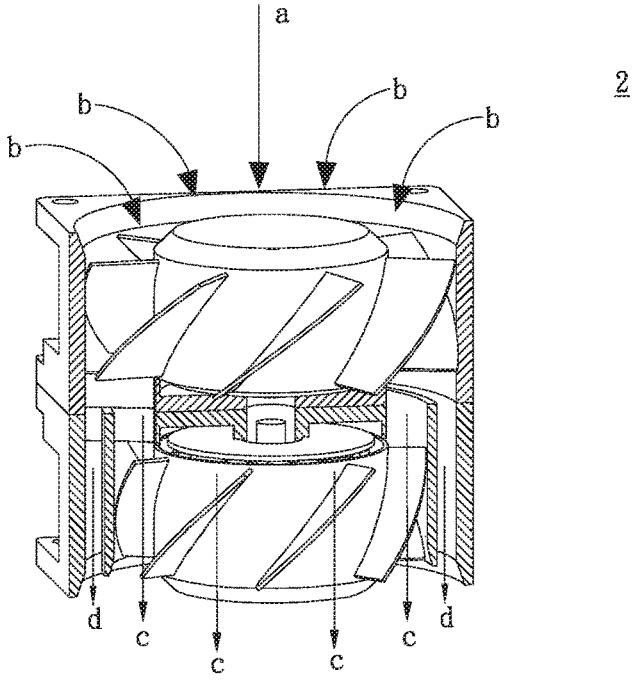

In this embodiment, the bypass structure 300 is formed on the first connection members 150 and positioned in the first flow way 110 to extend toward the first opening 111. The bypass structure 300 and the first frame body 100 and the first connection members 150 together define the bypass flow way 301. After the first fan 10 (including the first stator 170 and the first rotor 190) and the second fan 20 (including the second stator 280 and the second rotor 290) are activated to rotate, the external airflow a at the center of the first opening 111 of the first frame body 100 (referring to FIG. 6(*a*)) will be sucked from the first opening 111 into the first flow way 110 due to the rotation of the first rotor 190. The external airflow b at the surrounding of the first opening 111 will be sucked from the first opening 111 into the bypass flow way 301. The airflows a and b entering the first flow way 110 and the bypass flow way 301 will flow into the second flow way 210 of the second frame body 200 due to the rotation of the second rotor 290 and mix with each other to exhaust from the fourth opening 214.

In a modified embodiment, as shown in FIG. 5(*b*), the bypass structure 300 is formed on the second connection members 240 and positioned in the second flow way 210 to extend toward the fourth opening 214. The bypass structure 300 and the second frame body 200 and the second connection members 240 together define the bypass flow way 301. After the first fan 10 (including the first stator 170 and the first rotor 190) and the second fan 20 (including the second stator 280 and the second rotor 290) are activated to rotate, the external airflow a at the center of the first opening 111 of the first frame body 100 and the external airflow b at the surrounding of the first opening 111 (referring to FIG. 6(*b*)) will be sucked from the first opening 111 into the first flow way 110 due to the rotation of the first rotor 190 to form a mixed airflow c. The mixed airflows c entering the first flow way 110 will flow into the second flow way 210 of the second frame body 200 due to the rotation of the second rotor 290. Part of the mixed airflow c will be pushed by the first rotor 190 to enter the bypass flow way 301 to form bypass airflow d. The mixed airflow c and the bypass airflow d are both exhausted from the fourth opening 214.

Figure 7:
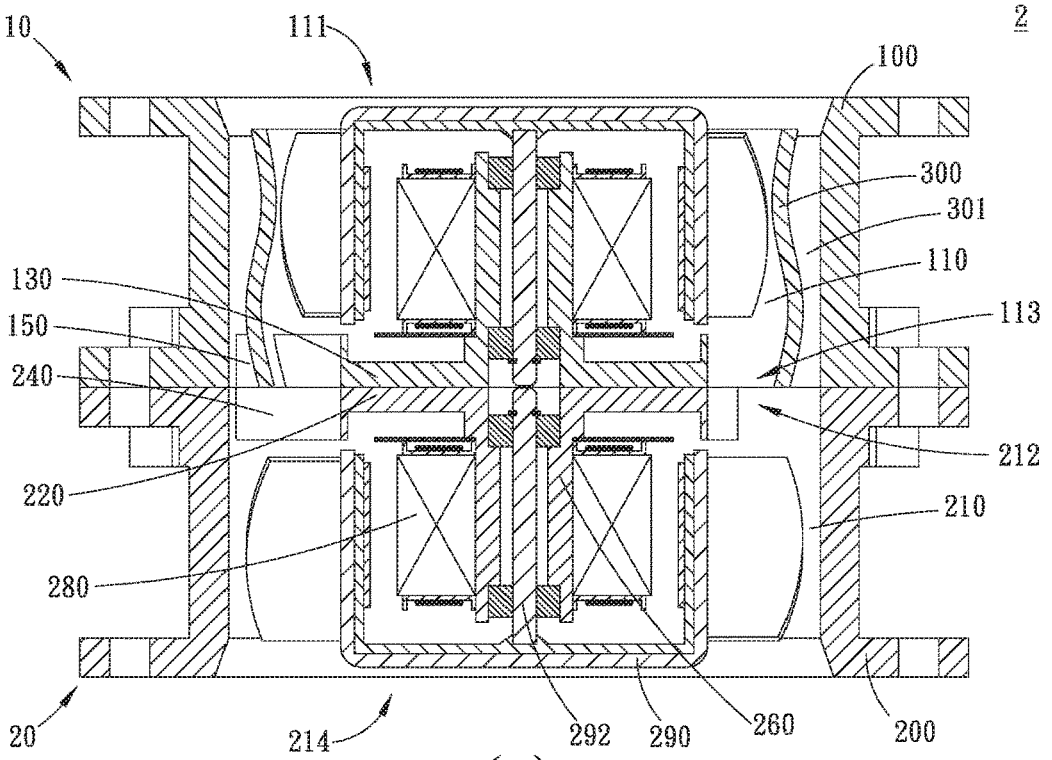
FIG. 7 is a sectional view of a second embodiment of the fan with the bypass structure of the present invention.
Figure 7:
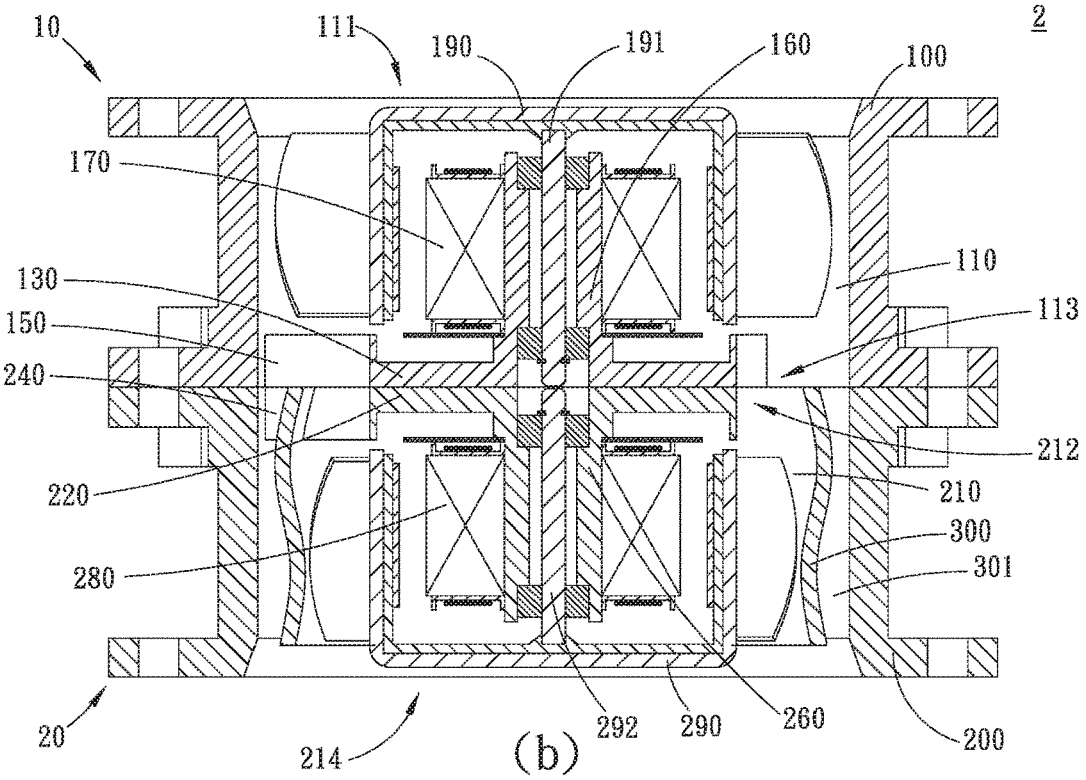

Please now refer to FIG. 7, which is a sectional view of a second embodiment of the fan with bypass structure of the present invention. Also referring to FIGS. 5 and 6, the second embodiment is partially identical to the first embodiment in structure and function and thus will not be repeatedly described hereinafter. The second embodiment is different from the first embodiment in that the bypass structure 300 has an S-shaped cross section, whereby the bypass flow way 301 also has an S-shaped cross section.

Figure 8:
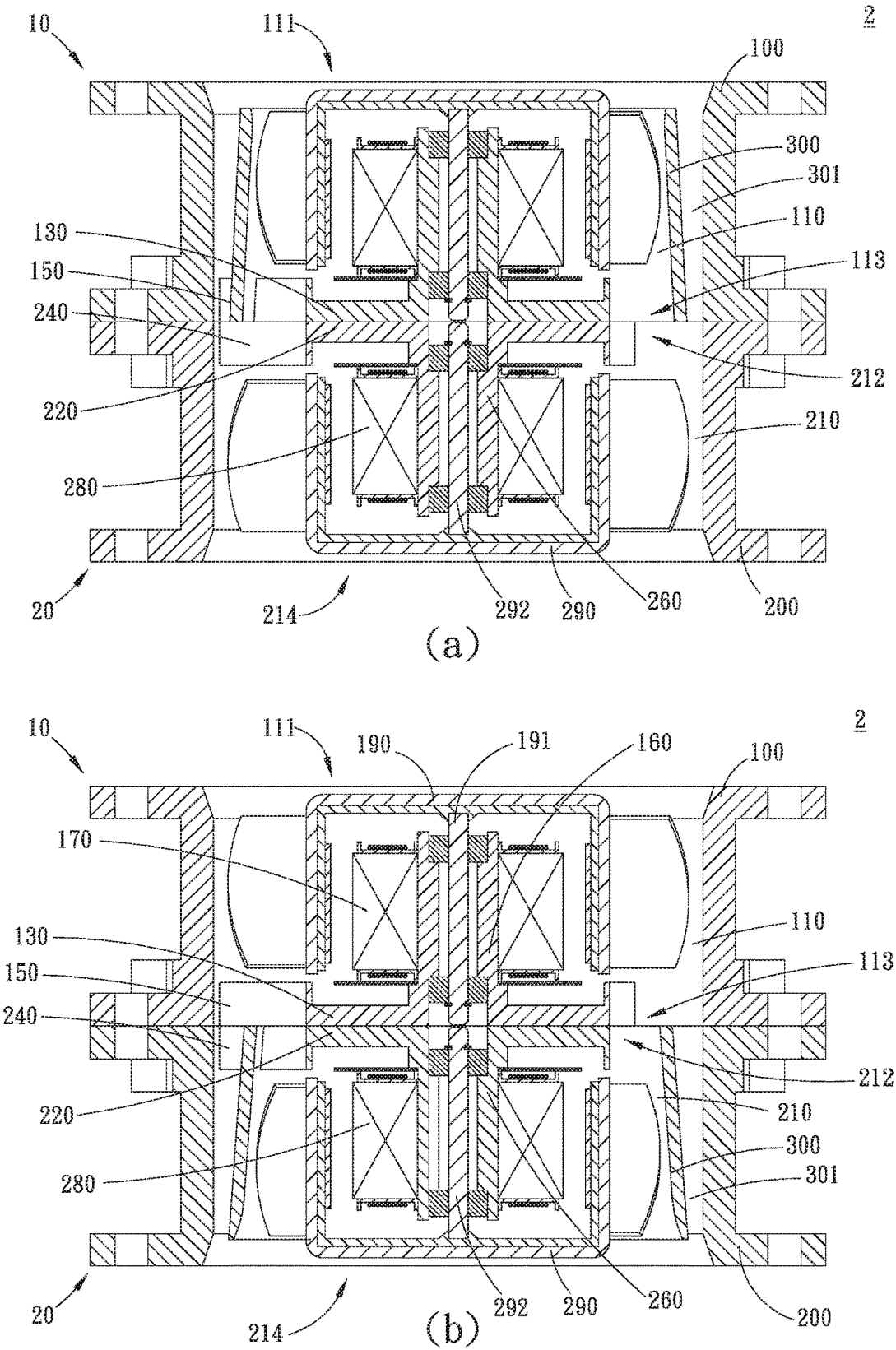
FIG. 8 is a sectional view of a third embodiment of the fan with the bypass structure of the present invention.

Please now refer to FIG. 8, which is a sectional view of a third embodiment of the fan with bypass structure of the present invention. Also referring to FIGS. 5 and 6, the third embodiment is partially identical to the first embodiment in structure and function and thus will not be repeatedly described hereinafter. The third embodiment is different from the first embodiment in that the bypass flow way 301 defined by the bypass structure 300 is a tapered flow way. For example, the bypass structure 300 is disposed in the first flow way 110 to extend toward the first opening 111 and the bypass flow way 301 is tapered from the first opening 111 to the second opening 113. Alternatively, the bypass structure 300 is disposed in the second flow way 210 to extend toward the fourth opening 214 and the bypass flow way 301 is tapered from the third opening 212 to the fourth opening 214. The tapered flow way has a larger cross-sectional area at upstream section and a smaller cross-sectional area at downstream section so that the flow speed of the airflow passing through the bypass flow way 301 is increased.

Figure 9:
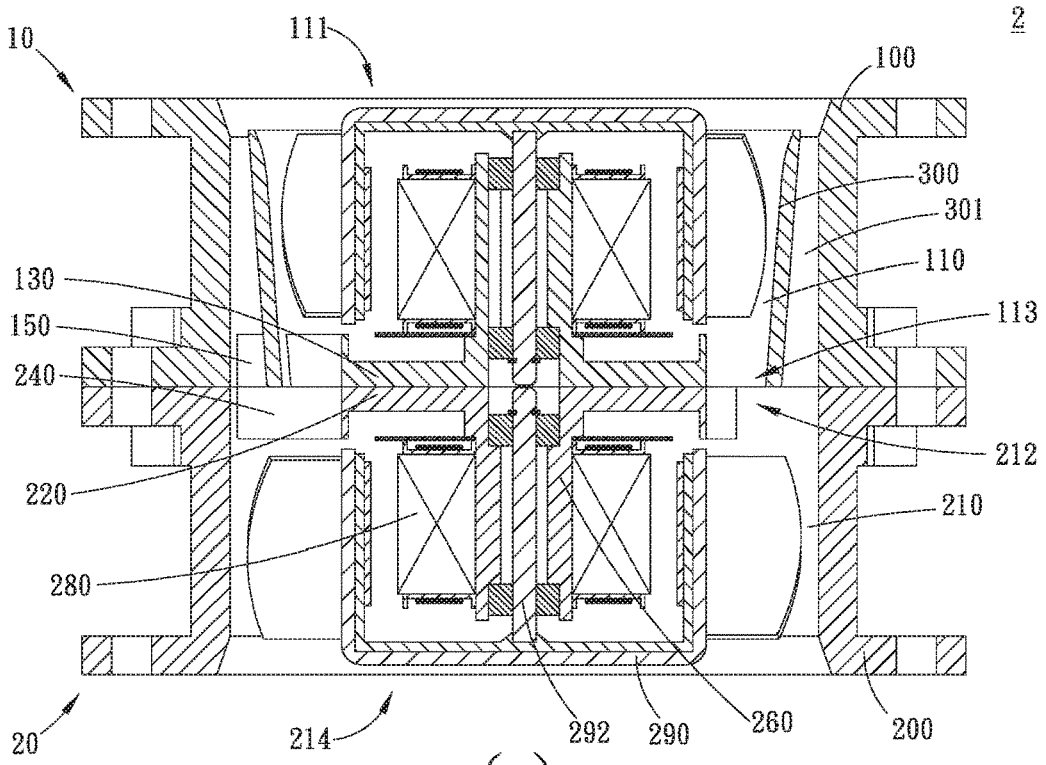
FIG. 9 is a sectional view of a fourth embodiment of the fan with the bypass structure of the present invention.
Figure 9:
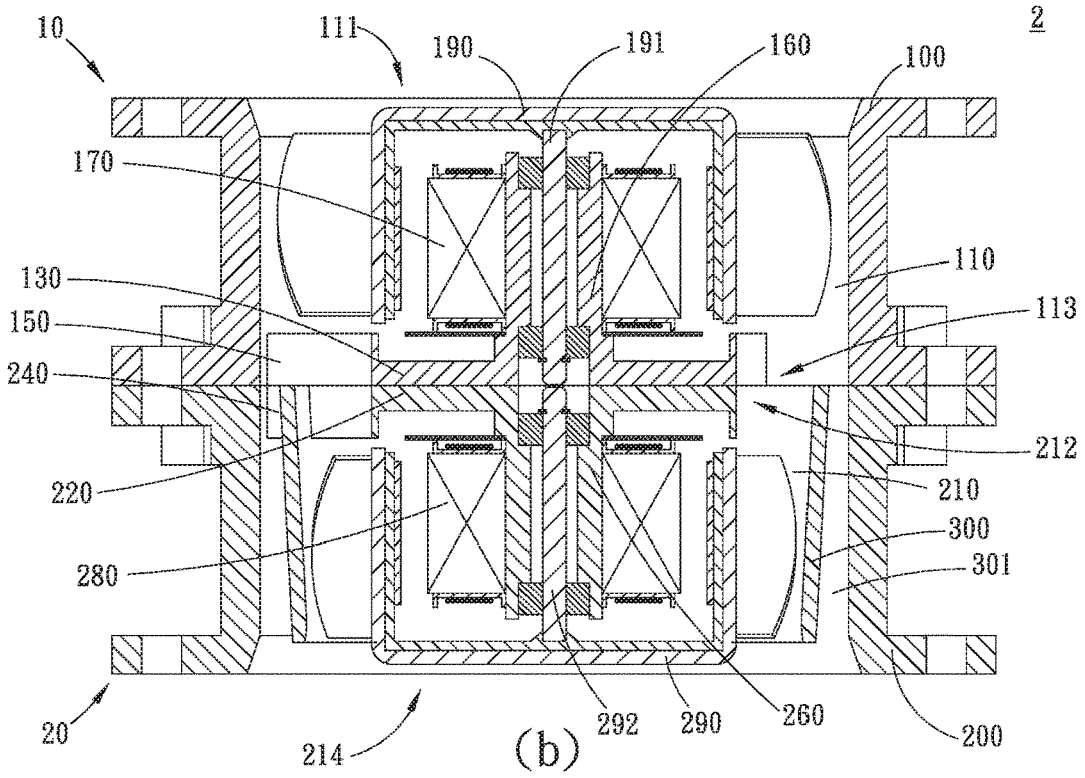

Please now refer to FIG. 9, which is a sectional view of a fourth embodiment of the fan with bypass structure of the present invention. Also referring to FIG. 5, the fourth embodiment is partially identical to the first embodiment in structure and function and thus will not be repeatedly described hereinafter. The fourth embodiment is different from the first embodiment in that the bypass flow way 301 defined by the bypass structure 300 is a diverging flow way. For example, the bypass structure 300 is disposed in the first flow way 110 to extend toward the first opening 111 and the bypass flow way 301 is diverged from the first opening 111 to the second opening 113. Alternatively, the bypass structure 300 is disposed in the second flow way 210 to extend toward the fourth opening 214 and the bypass flow way 301 is diverged from the third opening 212 to the fourth opening 214. The diverged flow way has a smaller cross-sectional area at upstream section and a larger cross-sectional area at downstream section. Therefore, after the external airflow at the surrounding of the first opening 111 is sucked into the bypass flow way 301, the flow speed of the airflow passing through the bypass flow way 301 is decreased and the pressure is increased, whereby the airflow can be truly pushed and exhausted outside.

By means of the design of the bypass structure 300, without increasing the size of the fan and without increasing the consumed power of the fan, the air volume of the fan can be enhanced.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A fan frame body with bypass structure, comprising:

a first frame body having a first flow way, a first opening disposed at one side of the first flow way, a second opening disposed at the other side of the first flow way;

a second frame body correspondingly serially connected with the first frame body, the second frame body having a second flow way, a third opening disposed at one side of the second flow way, while a fourth opening disposed at the other side of the second flow way, the third opening being aligned with the second opening, whereby the first flow way communicates with the second flow way; and a bypass flow way structure having an annular wall disposed in the first flow way or the second flow way, the annular wall defining a bypass flow way on a circumference of the first flow way or the second flow way, such that an airflow flowing through the first and second flow way partly bypasses the first or second flow way via the bypass flow way.

2. The fan frame body with bypass structure as claimed in claim 1, wherein a first base seat and multiple first connection members are disposed at the second opening, the first base seat being connected to the first frame body via the first connection members, the bypass structure being formed on the first connection members, the bypass structure and the first frame body and the first connection members together defining the bypass flow way.

3. The fan frame body with bypass structure as claimed in claim 2, wherein a second base seat and multiple second connection members are disposed at the third opening, the second base seat being connected to the second frame body via the second connection members, the bypass structure being formed on the second connection members, the bypass structure and the second frame body and the second connection members together defining the bypass flow way.

4. The fan frame body with bypass structure as claimed in claim 1, wherein the bypass structure has a straight or vertical-shaped cross section or a wavy-shaped cross section.

5. The fan frame body with bypass structure as claimed in claim 1, wherein the bypass flow way defined by the bypass structure is a tapered flow way or a diverging flow way.

6. A fan with bypass structure, comprising:

a first fan having a first frame body having a first flow way, a first opening disposed at one side of the first flow way, while a second opening disposed at the other side of the first flow way;

a second fan correspondingly serially connected with the first fan, the second fan having a second frame body correspondingly serially connected with the first frame body, the second frame body having a second flow way, a third opening disposed at one side of the second flow way, while a fourth opening disposed at the other side of the second flow way, the third opening being aligned with the second opening, whereby the first flow way communicates with the second flow way; and a bypass flow way structure having an annular wall disposed in the first flow way or the second flow way, the annular wall defining a bypass flow way on a circumference of the first flow way or the second flow way, such that an airflow flowing through the first and second flow way partly bypasses a part of the airflow, first or second flow way via the bypass flow way.

7. The fan with bypass structure as claimed in claim 6, wherein a first base seat and multiple first connection members are disposed at the second opening, the first base seat being connected to the first frame body via the first connection members, the bypass structure being formed on the first connection members, the bypass structure and the first frame body and the first connection members together defining the bypass flow way.

8. The fan with bypass structure as claimed in claim 7, wherein the first fan further has a first bearing cup, a first stator and a first rotor, the first bearing cup being disposed on the first base seat to extend toward the first opening, the first stator being annularly disposed around the first bearing cup, the first rotor via a first shaft being inserted in the first bearing cup corresponding to the first opening.

9. The fan with bypass structure as claimed in claim 8, wherein a second base seat and multiple second connection members are disposed at the third opening, the second base seat being connected to the second frame body via the second connection members, the bypass structure being formed on the second connection members, the bypass structure and the second frame body and the second connection members together defining the bypass flow way.

10. The fan with bypass structure as claimed in claim 9, wherein the second fan further has a second bearing cup, a second stator and a second rotor, the second bearing cup being disposed on the second base seat to extend toward the fourth opening, the second stator being annularly disposed around the second bearing cup, the second rotor via a second shaft being inserted in the second bearing cup corresponding to the fourth opening.

11. The fan with bypass structure as claimed in claim 6, wherein the bypass structure has a straight or vertical-shaped cross section or a wavy-shaped cross section.

12. The fan with bypass structure as claimed in claim 6, wherein the bypass flow way defined by the bypass structure is a tapered flow way or a diverging flow way.

* * * * *